US006161597A

United States Patent [19]

Meyns et al.

[11] Patent Number: 6,161,597

[45] Date of Patent: Dec. 19, 2000

[54] GRIPPER WEAVING MACHINE

[75] Inventors: Ignace Meyns, Reninge; Kurt Slosse, Boezinge, both of Belgium

[73] Assignee: Picanol NV, Ypres, Belgium

[21] Appl. No.: 09/423,252

[22] Filed: Feb. 7, 2000

[30] Foreign Application Priority Data

May 7, 1997 [BE] Belgium ..... 09700405

[51] Int. Cl.[7] ..... D03D 47/27

[52] U.S. Cl. ..... 139/449

[58] Field of Search ..... 139/449

[56] References Cited

U.S. PATENT DOCUMENTS 5,179,979 1/1993 Zollinger ..... 139/449

5,413,151 5/1995 Moeneclaey ..... 139/449

FOREIGN PATENT DOCUMENTS 0 275 479 7/1988 European Pat. Off. .

*Primary Examiner*—Andy Falik

*Attorney, Agent, or Firm*—Bacon & Thomas, PLLC

[57] ABSTRACT

A gripper weaving machine having at least one rapier (1) which carries a gripper (3) and is driven by a drive wheel (9) and which is guided outside a shed by guide elements (13, 15), where the guide elements are part of guidance devices and are arranged to rotate the rapier (1) about its longitudinal axis (28).

11 Claims, 12 Drawing Sheets

GRIPPER WEAVING MACHINE

BACKGROUND OF THE INVENTION

1. Field of the Invention

The invention relates to a gripper weaving machine comprising at least one rapier carrying a gripper and being moveable into and then out of a shed by a drive wheel and being guided outside the shed by guide elements that maintain the rapier in contact against the drive wheel and in alignment with the shed.

2. Description of the Related Art

U.S. Pat. No. 5,413,151 discloses a gripper weaving machine wherein a filling thread is inserted into a shed by two grippers each affixed to a flexible rapier. A feed gripper moves the filling from one side of the shed to about its middle where it is transferred to a receiving gripper which thereupon carries this filling to the opposite side of the shed. Each rapier is moved by a drive wheel into and out of the shed. Guide elements located outside the shed guide the rapier between the drive wheel and the shed. These guide elements keep the rapiers in contact with the drive wheel and in alignment with the shed. Guidance devices are mounted on the batten and can be moved into and out of the shed for guiding the rapiers within the shed. When a rapier enters the shed, the batten together with its affixed guidance devices are situated in a rear position in order that these guidance devices (which are now inside the shed) are able to receive the rapier from the guide elements mounted adjacent to the shed.

As regards such gripper weaving machines, the position of the rapier within the shed is determined essentially by the arrangement of drive wheels on the frame of the gripper weaving machine. The angle subtended between the drive wheels and the frame and the geometry of the shed conventionally are selected in such manner that the rapier shall assume a position within the shed whereby the largest possible number of different warps and fillings can be woven together without incurring unduly numerous thread ruptures in the vicinity of the guide elements that are moved into and out of the shed. However setting the drive-wheel angle of a gripper weaving machine restricts the number of possible warps and fillings that may be woven together. Once the angle at which the drive wheels are mounted on the frame has been set, it is subsequently practically impossible to change the same in a gripper weaving machine.

SUMMARY OF THE INVENTION

The objective of the invention is to create a gripper weaving machine of the type described that permits a larger number of fillings and warps to be woven together using a larger number of shed geometries.

This problem is solved in that the guide elements comprise guidance devices rotated relative to each other and extending essentially tangentially relative to the drive wheel in the area adjacent the wheel.

The invention permits the change in position or angular orientation at which the weaving machine rapiers can be inserted into a shed while the drive wheels are mounted at a specified angle relative to the frame of said weaving machine. The guides mounted outside of the shed apply torque to the rapier(s), and as a result of which the position or angular orientation of the rapiers inside of the shed will be substantially independent of the angular position of the drive wheels. Consequently the position or angular orientation of the rapier(s) can be matched to a desired shed geometry, depending essentially on the kind of warps and the kind of fillings that are used in weaving. Thus, it is possible to optimally weave a larger number of various types of warps and fillings even though the drive wheels are mounted at a predetermined angle to the frame of the weaving machine.

In order to easily implement the setting position or angle of the rapier(s), two or more guide elements having guidance devices that are rotated at different angles are used and mounted in a transferable manner on the gripper weaving machine.

In a preferred embodiment, a first guide element is mounted near the vicinity of the drive wheel and a second guide element is mounted away from the first element adjacent to the shed, and the outlet of the second element is rotated toward a plane that is tangential to the drive wheel. In a preferred embodiment, the first and second guide elements constitute substantially and mutually rotated straight guides for the rapier. The rotation of the rapier and thereby the setting of the position or angle assumed by the rapier in the shed will be carried out between the first and second guide elements.

In another preferred embodiment of the invention, a one-part or multi-part third guide element that rotates the rapier is mounted between the first and the second guide elements. In this embodiment the rapier is guided in the region in which it is rotated.

In a further embodiment, the third guide element consists of two leaf springs that are kept in a rotated position about a longitudinal axis extending in the direction of movement of the rapier and guiding this rapier between the springs. In this embodiment, the rapier is rotatable in a so-called natural deformation made so that stresses generated by the rotation of the rapier are kept small.

In a further embodiment, a third guide element having several consecutive parts is mounted between the first and the second guide elements, wherein the guides of said third element are rotated starting from the first guide element in increasingly stepwise angles. During this rotation the rapier is guided at various positions and accordingly, it assumes controlled positions during this rotation.

In a further embodiment of the invention, the second guide element forms a guide rotated onto itself in which the inlet substantially aligns with the outlet of the first guide element. In this design the gripper element is guided in a defined manner during its rotation.

In a further embodiment of the invention, the second guide element, together with the single-part or multi-part third guide element and/or with the first guide element, forms an exchangeable sub-assembly. Such a sub-assembly can be accurately pre-assembled, as a result of which the individual guide elements can align precisely with each other and with the drive wheel, as well as with the shed. Furthermore the sub-assembly can be aligned in a simple manner so as to be accurately aligned with the longitudinal axis of the rapier.

A preferred embodiment of the invention comprises a rapier with a feed gripper and a rapier with a receiving gripper which are respectively guided by guide elements that are positioned at the opposite sides of the shed and incrementally rotate the associated rapier at the same or various angles. Because the alignment of the two rapiers with respect to one another are selectable, this permits the matching of the shed geometry with various warps and fillings.

BRIEF DESCRIPTION OF THE DRAWINGS

Additional features and advantages of the invention are described in the description below of the illustrative embodiments shown in the drawings.

DETAILED DESCRIPTION OF THE PREFERRED EMBODIMENTS

Figure 1:
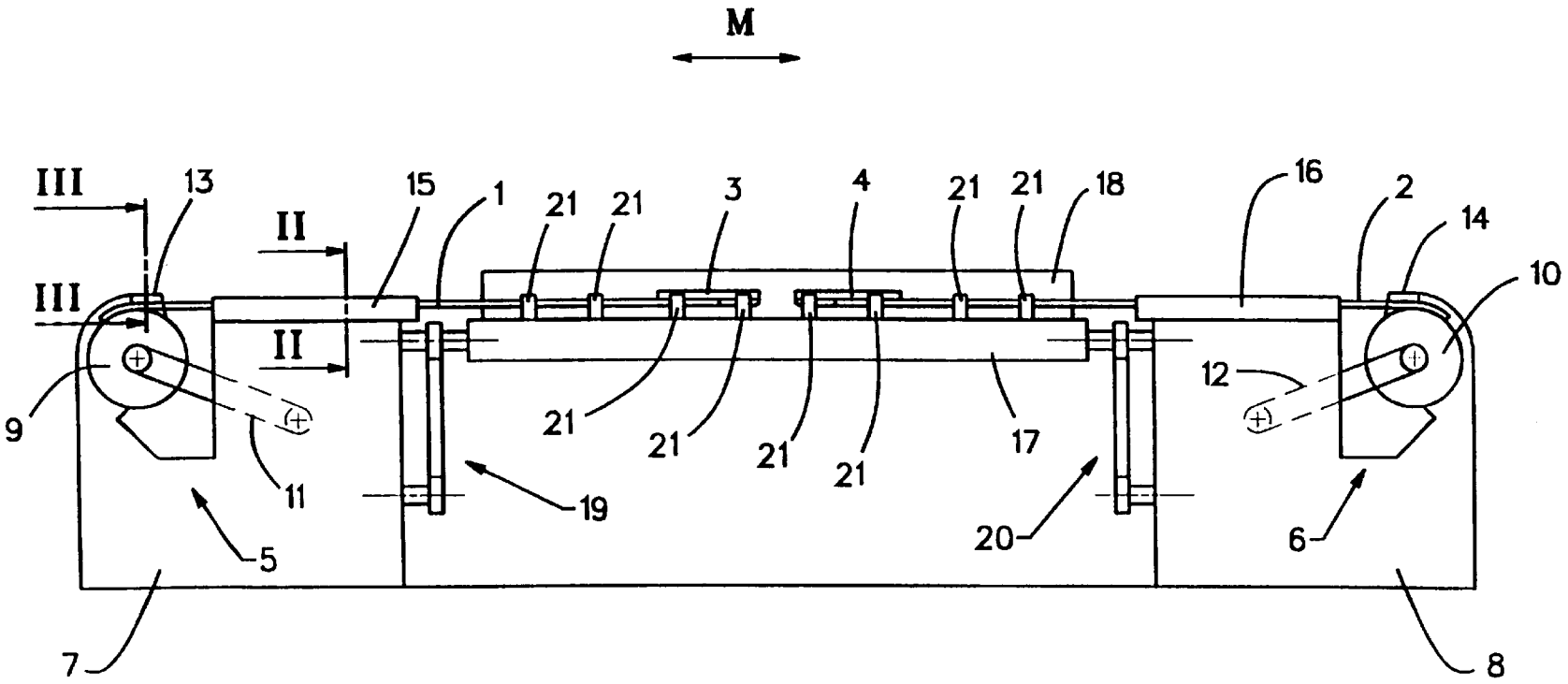
FIG. 1 is a schematic of a gripper weaving machine comprising the guide elements of the invention.

The gripper weaving machine shown in FIG. 1 comprises two rapiers 1, 2 which move a feed gripper 3 and a receiving gripper 4 opposite in the direction of motion M into and then out of a shed. The rapiers 1, 2 are moved by drives 5, 6 that are affixed to side frames 7, 8 of the weaving machine. The side frames 7,8 each contain one drive wheel 9, 10 to move the associated rapier 1, 2. The rapiers 1, 2 are respectively affixed at one end to the drive wheels 9, 10 about which they extend from. The drive wheels 9, 10 are driven by a power transmission 11, 12.

The gripper weaving machine is configured with stationary guide systems outside the shed to guide the rapiers 1, 2 between the respective drive wheel 9, 10 and the shed. These guide systems each contain first guide elements 13, 14 that, in the vicinity of the drive wheels 9, 10, guide the rapiers 1, 2 substantially tangentially to said wheels and keep said rapiers in contact with said wheels. Furthermore the guide systems contain second guide elements 15, 16 mounted next to the shed and which align the rapiers 1, 2 relative to this shed. These guide elements 15, 16 are affixed to the side frames 7, 8 at a distance from the first guide elements 13, 14.

A batten 17 is supported between the side frames 7, 8 and supports a reed 18. The batten 17 is configured with drives 19, 20 that operate synchronously with the drives 5, 6. Additionally, individual guide posts 21 are affixed to the batten 17 and, during the movement of the batten 17, the posts 21 are displaced into and then out of the shed and guide the rapiers 1, 2 within the shed. Similar guide posts 21 are disclosed for instance in U.S. Pat. No. 5,413,151 and hence further description is not needed.

Figure 2:
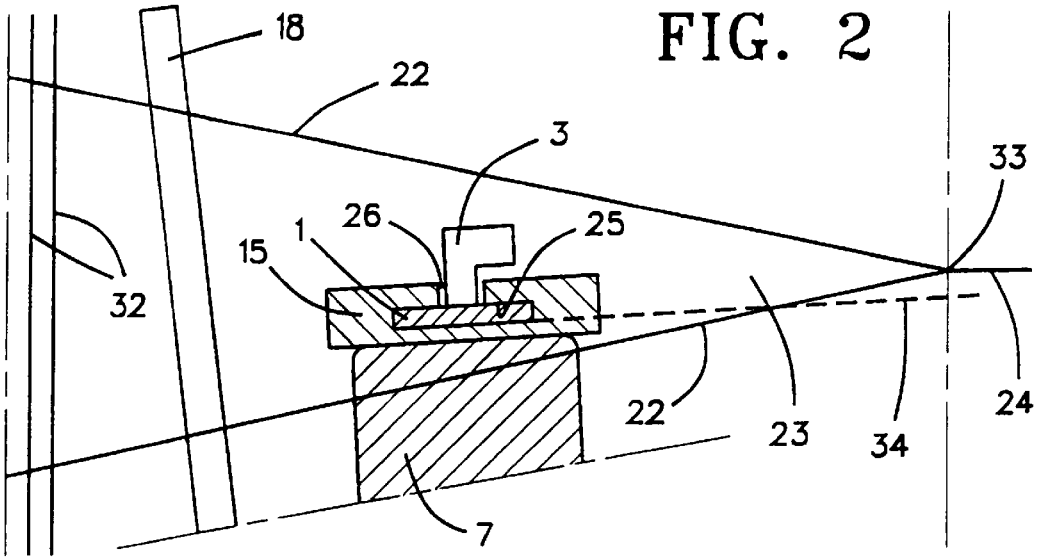
FIG. 2 is a section along line II—II of FIG. 1.
Figure 3:
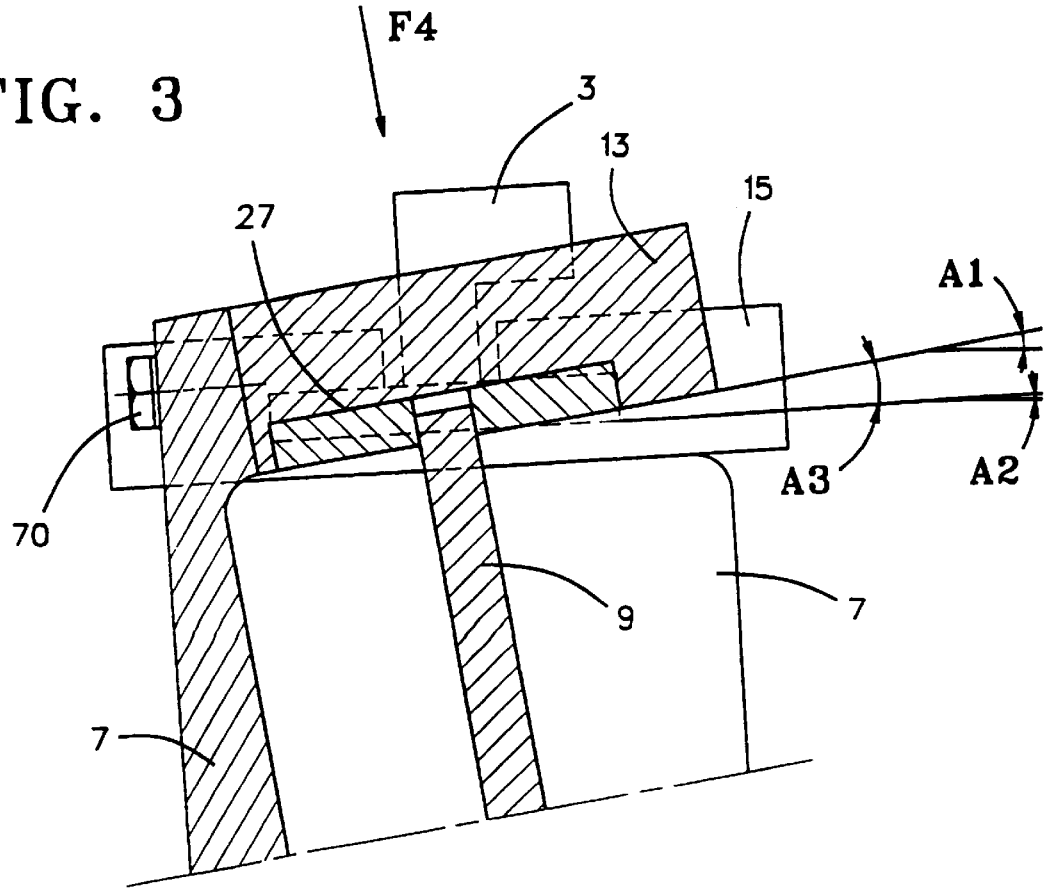
FIG. 3 is a section on a larger scale along line III—III of FIG. 1.
Figure 4:
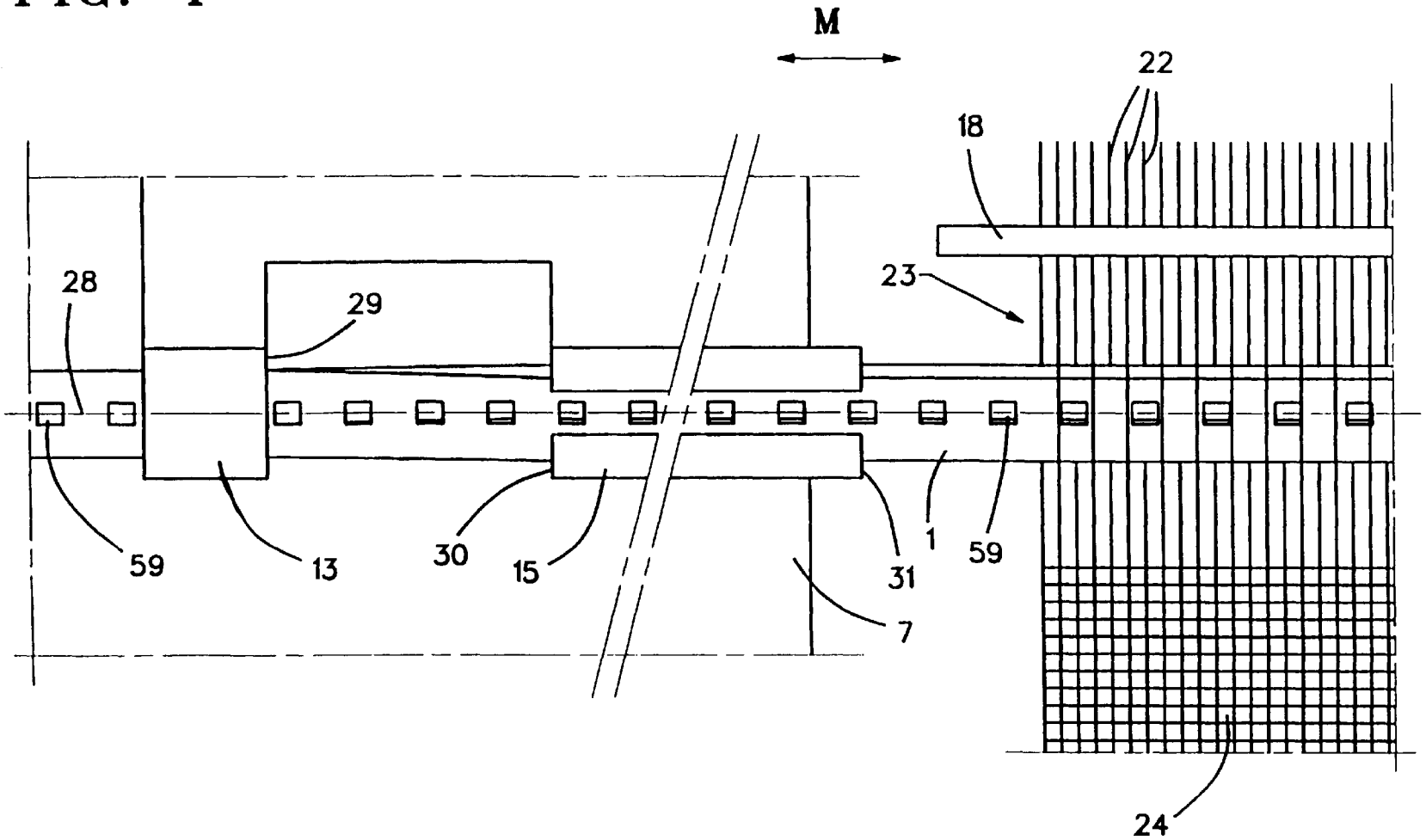
FIG. 4 is a view in the direction of the arrow F4 of FIG. 3.
Figure 5:
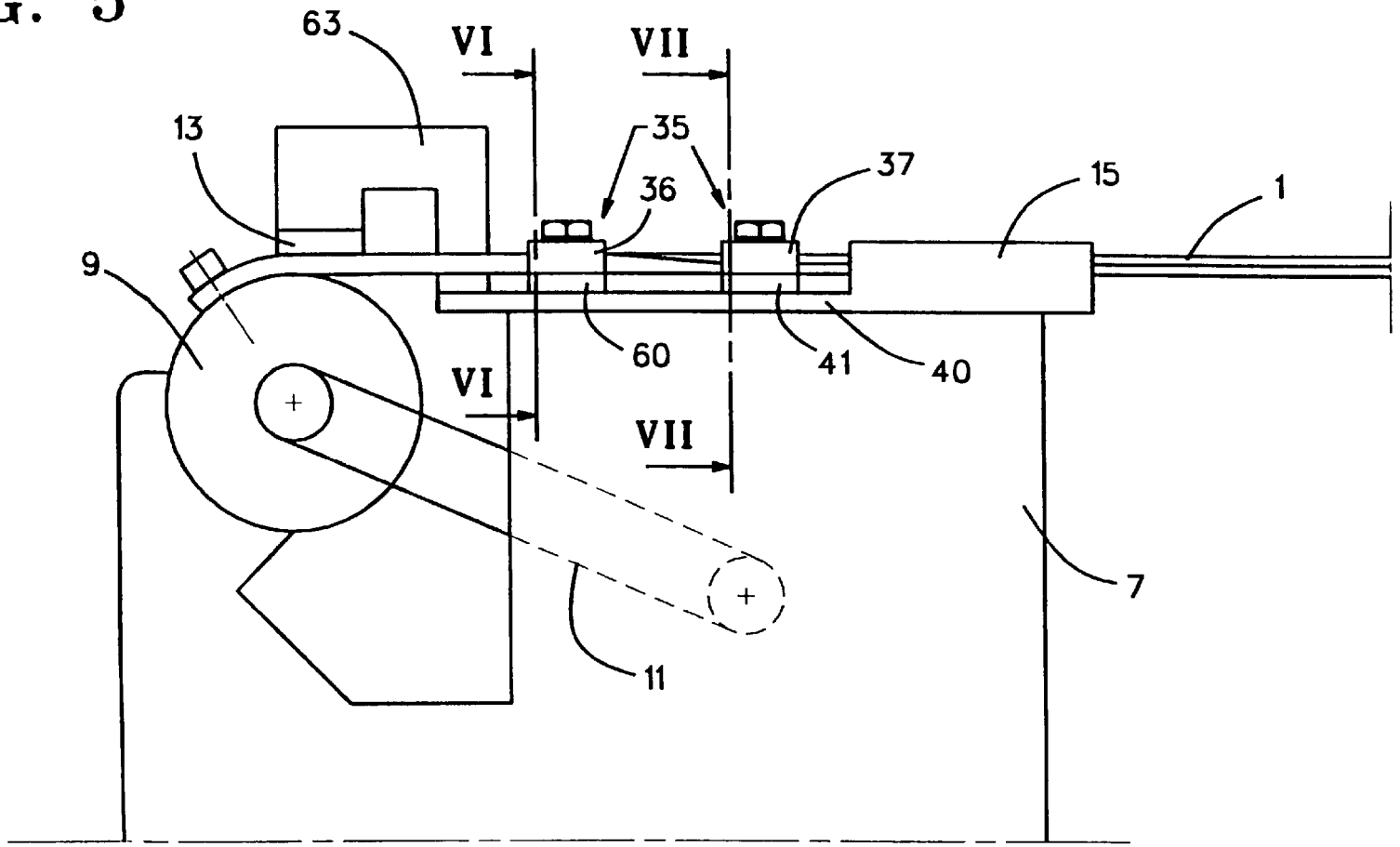
FIG. 5 is a schematic of part of a modified gripper weaving machine in the direction of the arrow F5 of FIG. 6.
Figure 6:
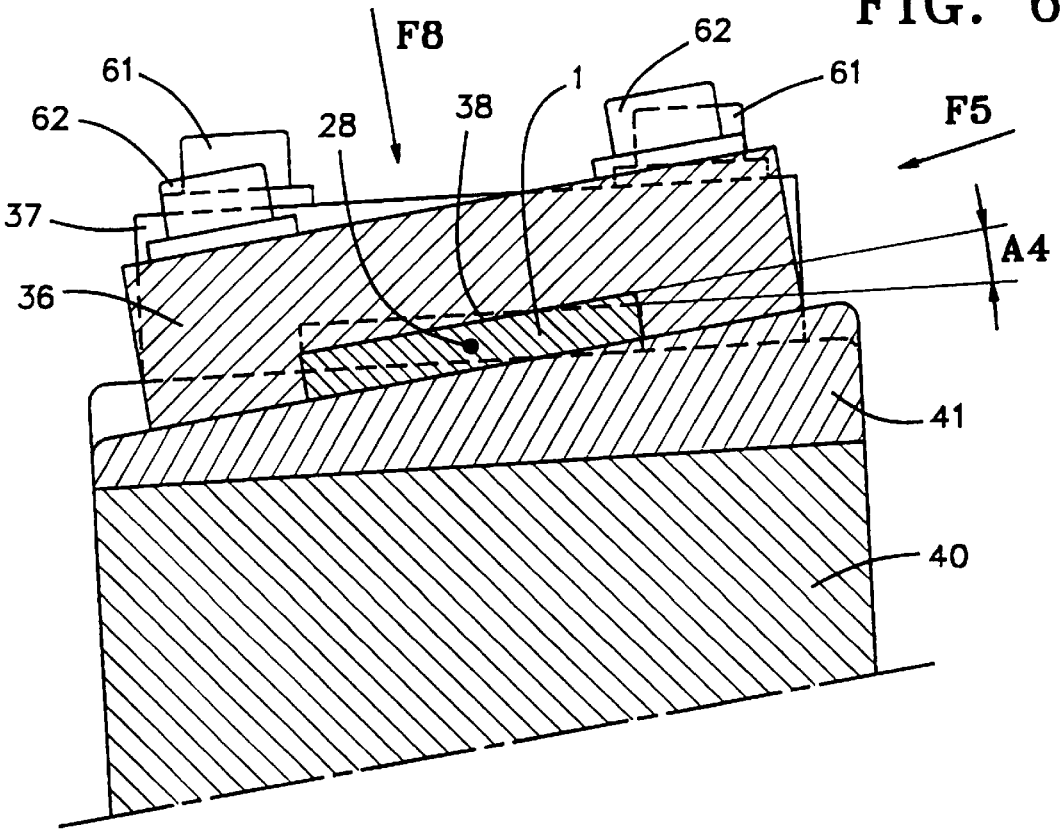
FIG. 6 is a section on a larger scale along line VI—VI of FIG. 5.
Figure 7:
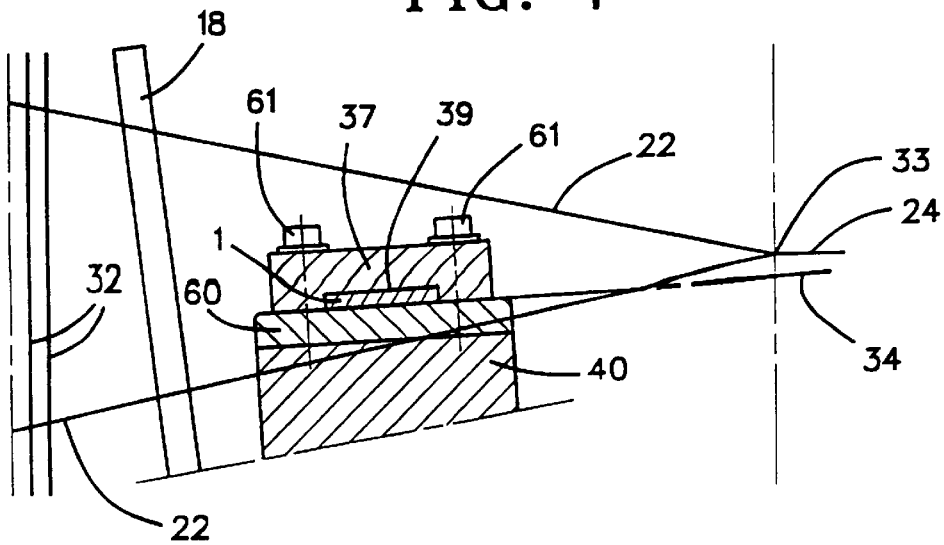
FIG. 7 is a section along line VII—VII of FIG. 5.
Figure 8:
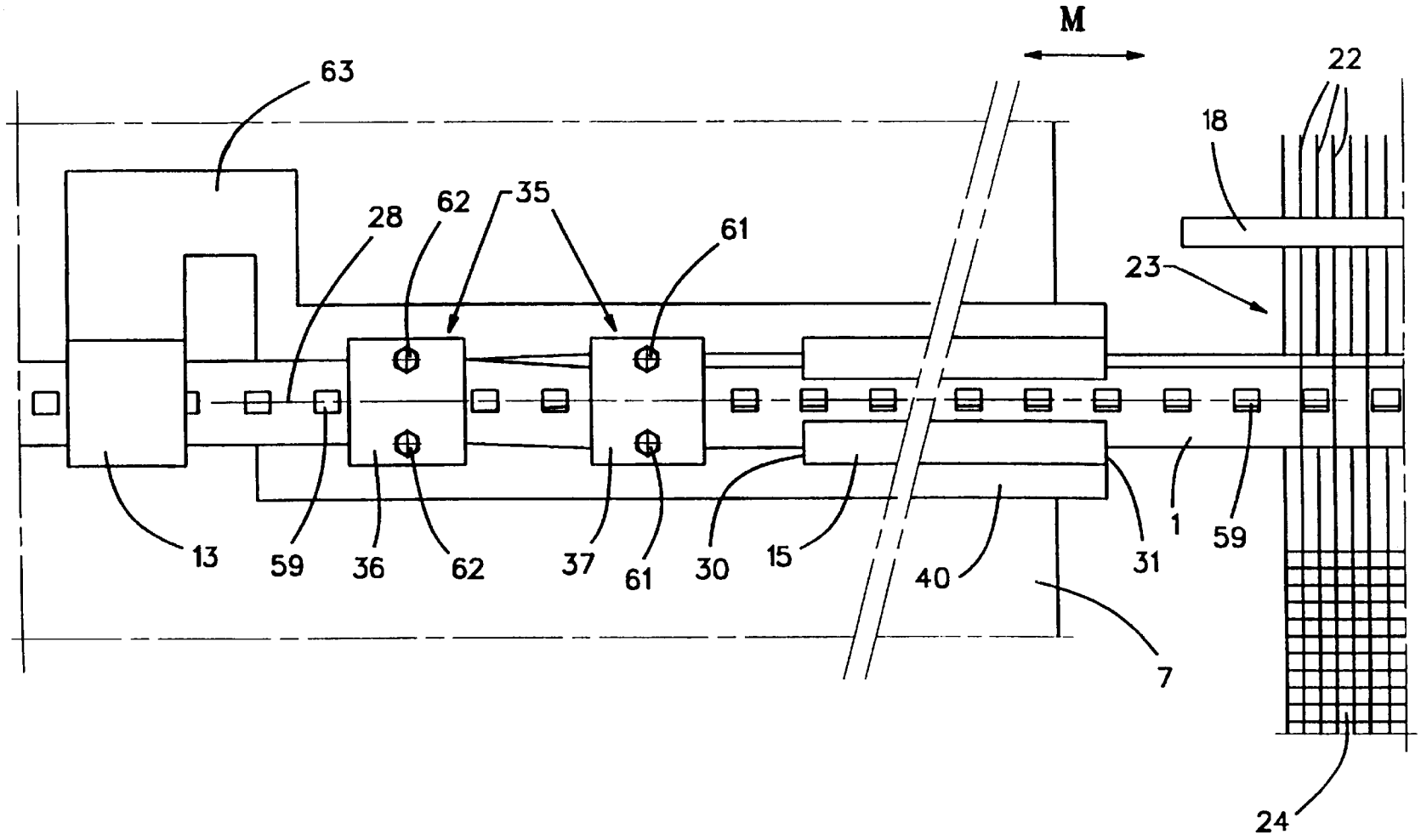
FIG. 8 is a view in the direction of the arrow F8 of FIG. 6.

FIGS. 2 to 4 schematically show warps 22 and the shed 23 formed by the warps, and the fabric 24. The warps 22 are guided in the weaving direction by the reed 18 and substantially run across the full width of this reed 18. The shed 23 is subtended between two sets of warps and is bounded by the reed and the fell line 33 of the fabric 24, with the fillings being forced against said fell line. The shed 23 will be completely open when the batten 17, together with the reed, is situated in the rear position on a side away from the fabric 24. In this position, the guide posts 21 will be inside the shed 23 and will substantially be flush with the stationary second guide elements 15, 16 that are mounted adjacent to the shed 23. The shed 23 is built up by shed forming means indicated merely in symbolic manner, such means being harnesses 32 for instance. The underside of the rapier 1 that is essentially plane and rectangular in cross-section runs in a plane 34 underneath the fell line 33 of the fabric 24. The position and extent of this plane 34 assumes substantial significance by affecting the number of potential thread ruptures in the region of the guide posts 21.

The first guide elements 13 consist preferably of a metallic block (FIG. 3) affixed by screws 70 to the side frame 7. This block is configured with a U-shaped clearance 27 that is open toward the drive wheel 9 and guides the top and narrow sides of the rapier. The guide geometry of the first guide element 13 is in the form of the clearance 27 that runs in a plane that is tangential to the drive wheel 9. The drive wheel 9 is a gear with its teeth engaging the clearances 59 of the rapier 1. As shown in FIG. 3, the drive wheel 9 is slightly tilted in order for the rapier 1 to be guided in the clearance 27 of the first guide element 13 that subtends an angle Al with the horizontal.

The second guide element 15 is stationary and affixed to the side frame 7 and comprises a clearance 25 matching the cross-section of the rapier 1 and in this embodiment, this clearance 25 is rectangular and encloses the rapier 1 so as to provide guidance for the top, lower and narrow sides of said rapier 1. The rapier 1 is guided inside this clearance 25 without substantial play and is constrained by the clearance geometry. The clearance 25 runs in the direction of motion M of the rapier 1. The clearance 25 is open upwards through a slot 26 and as a result, the feed gripper 3 can move as far into the vicinity of the guide element 15. As shown by FIG. 2, the guide element 15 guides the rapier 1 by means of guiding surface 25 in such manner that the underside of said rapier is positioned in the plane 34.

As shown by FIG. 3, the guide element 15 together with its guiding surface or clearance 25 is rotated about the longitudinal center axis 28 of the rapier 1 such that this rapier 1 subtends an angle A2 with the horizontal in the vicinity of the guide element 15 and is oriented at this angle towards the shed 23. The rapier 1 is rotated by an angle A3 about its longitudinal center axis 28, between the outlet 29 of the first guide element 13 and the intake 30 of the second guide element 15. This rotation of rapier 1 is also shown in FIG. 4 in the vicinity of the apertures 59 and the narrow sides.

By rotating the rapier 1, it is possible to change the position or the angular orientation of the rapier 1 in the region of the shed 23 regardless of the position and angular orientation of this rapier 1 as it leaves the drive wheel 9 and returns to it. The guide element 15 mounted on the side frame 7 can be replaced by similar guide elements which are rotated at different angles A3 relative to the guide element 13, and as a result the underside position of the rapier 1 can be changed within the shed even though the angular orientation of the drive wheel 9 remains unchanged. Similarly the angular orientation of the guide element 15 can be adjusted by wedging or the like. Rotating the rapier 1 in the region between the shed 23 and the drive wheel 9 permits the matching of the position or angular orientation of the rapier within the shed 23 according to the various kinds of warps and fillings to be used, and to the appropriate shed geometries used with such warps and fillings.

As regards the embodiment of FIGS. 5–8, a two-part third guide element 35 is mounted between the first and second guide elements 13 and 15 respectively. The third guide element 35 comprises two mutually spaced blocks 36, 37 associated with the first and second guide elements 13 and 15, said blocks being configured with straight clearances 38 and 39 respectively operating as guides and enclosing the top and side surfaces of the rapier. The underside of the rapier 1 is guided by strips 60, 41 in the region of the blocks 36 and 37, said strips covering the clearances 38, 39 and together with the clearances 38,39 forming a guidance system enclosing the rapier 1 on all sides. The guidance system formed by the block 36 and the strip 60 runs flush to the guidance system of the first guide element 13, whereas the guidance system formed by the block 37 and the strip 41 runs flush to the second guide element, as a result of which, the system is rotated between the blocks 36, 37 of the third guide element 35 as illustratively shown in FIG. 8. The blocks 36, 37 and the strips 41, 60 are fastened with screws 62,61 to an adapter of the second guide element 15. In this embodiment the strip 41 is cross-sectionally wedge-shaped and the strip 60 is cross-sectionally rectangular. As shown by FIGS. 5 through 8, the adapter 40 of the second guide element 15 is extended by a holder 63 to which is affixed the first guide element 13. In between the first guide element 13, the second guide element 15 and the third guide element 35, a sub-assembly is formed which is easily replaceable when the angle of rotation A4 of the rapier 1 (FIG. 6) must be changed. In this manner, the entire sub-assembly is easily oriented relative to the longitudinal center axis 28 of the gripper 1.

Figure 9:
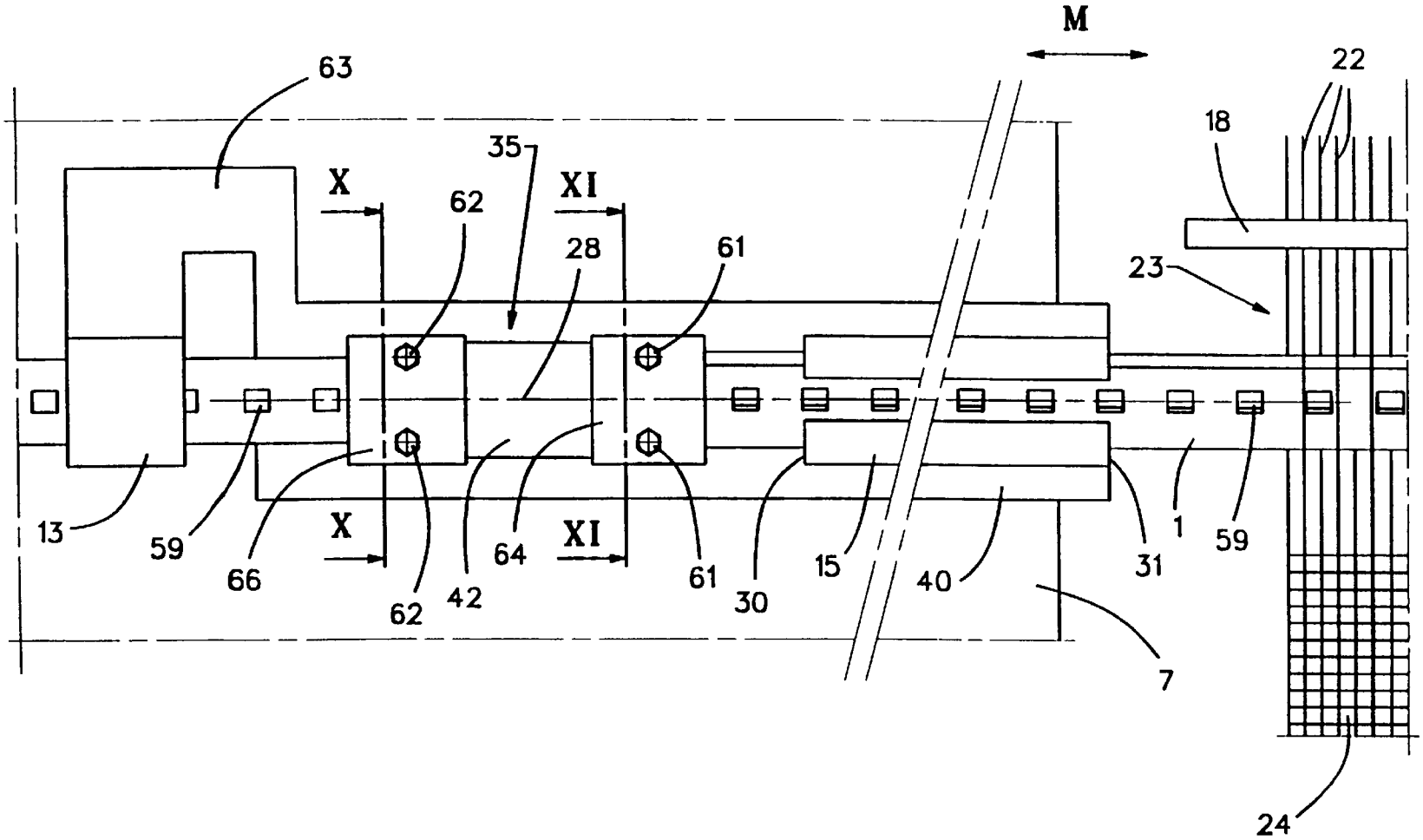
FIG. 9 is a view similar to FIG. 8 of a modified embodiment in the direction of the arrow F9 of FIG. 10.
Figure 10:
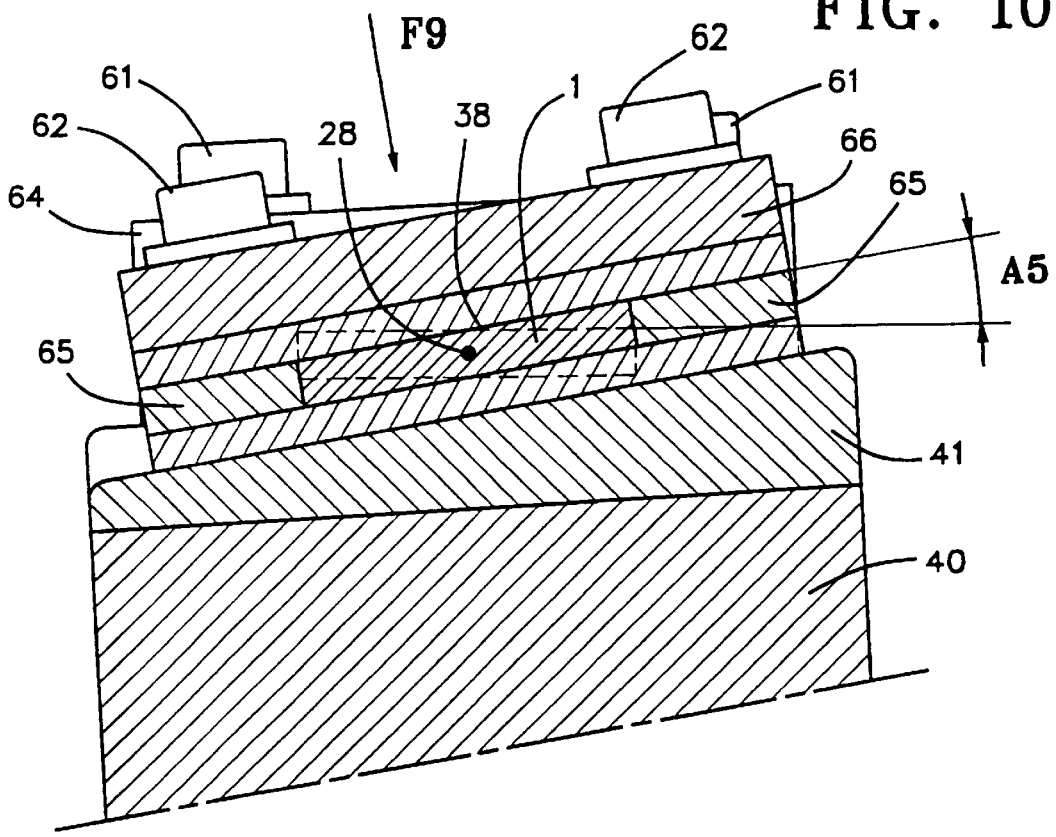
FIG. 10 is an enlarged section along line X—X of FIG. 9
Figure 11:
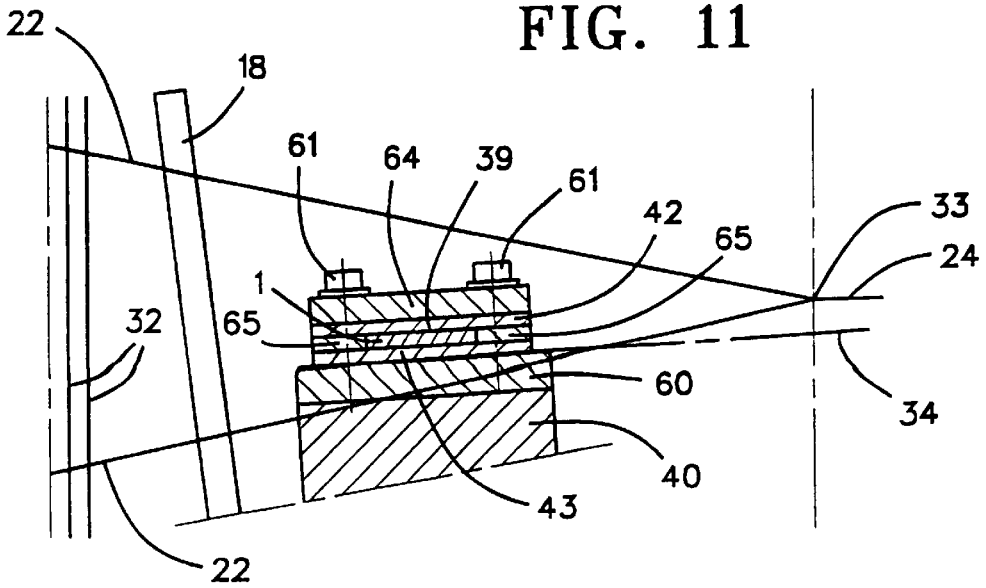
FIG. 11 is a section along line XI—XI of FIG. 9.

As regards the embodiment of FIGS. 9–11, the rapier 1 is guided between two leaf springs 42, 43 in the region of the third guide element, the leaf spring 42 resting against the top side and the leaf spring 43 against the underside of the rapier. The leaf springs 42, 43 are held apart in two positions between the retaining pieces 64, 66 affixed by screws to the strips 41, 60. Spacers 65 are mounted between the leaf springs 42, 43 and guide the narrow sides of the rapier 1 and are of a thickness matching that of the rapier. The two leaf springs 42, 43 are configured in such manner that the intake facing the first guide element 13 is aligned with this guide element 13 and the outlet is aligned with the guide element 15, as a result of which the rotation of the rapier 1 takes place in the region of the leaf springs 42, 43. In this process the rapier 1 is guided at its top side and bottom side by the leaf springs 42, 43 and by the spacers 65 at the two narrow sides. FIG. 10 shows that the rapier 1 is rotated by an angle A5. For the sake of clarity, the rapier 1 that was rotated about its center longitudinal axis 28 is shown in broken lines in the position it assumed at the outlet of the middle guide 35 and in the region of the second guide element 15. The longitudinal center axis 28 of the rapier 1 runs substantially straight, between the first and second guide elements 13 and 15.

Figure 12:
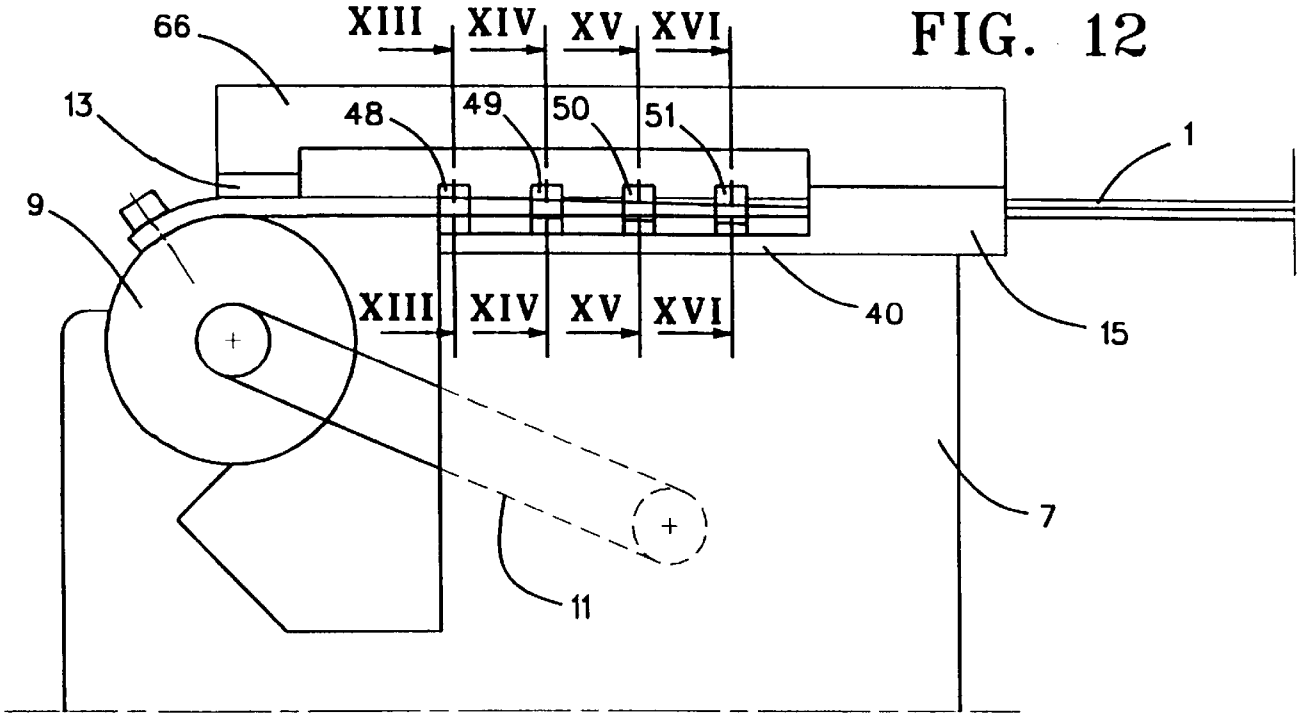
FIG. 12 is a schematic view similar to FIG. 1 of part of another embodiment.
Figures 13, 14, 15, 16:
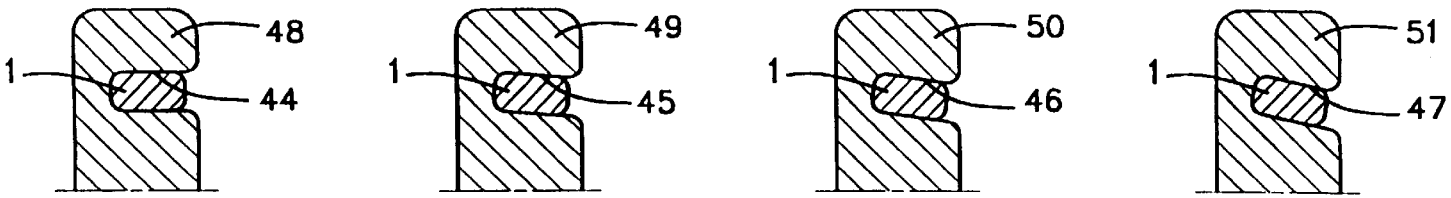
FIGS. 13–16 are sections along lines XIII—XIII, XIV—XIV, XV—XV and XVI—XVI of FIG. 12.

In the embodiment shown in FIGS. 12 and 13, the third guide element 35 consists of several consecutively arranged posts 48, 49, 50, 51 each configured with a guide slot 44, 45, 46, 47 for the rapier 1. The rapier 1 of this embodiment differs in its cross-section from that shown in FIGS. 1 through 11 and is guided only at the top side, at the lower side and at one narrow side by the guide slots 44 through 47. The slot 44 of the post 48 facing the first guide element 13 runs flush with the guidance device of this first guide element 13. The slot 47 of the post 51 facing the second guide element 15 runs flush with the guidance device of this second guide element 15. Accordingly the rapier 1 is rotated stepwise, in each instance between the posts 48, 49, 50 and 51, at increasing angles from the post 48 to the post 51. The posts 48 through 51 are affixed to the adapter 40 of the second guide element 15. This second guide element 15 is configured with retention means including retaining piece 66 to which is affixed the first guide element 13. As a result, the guide means constitute a sub-assembly mounted to the side frame 7 of the gripper weaving machine.

Figure 17:
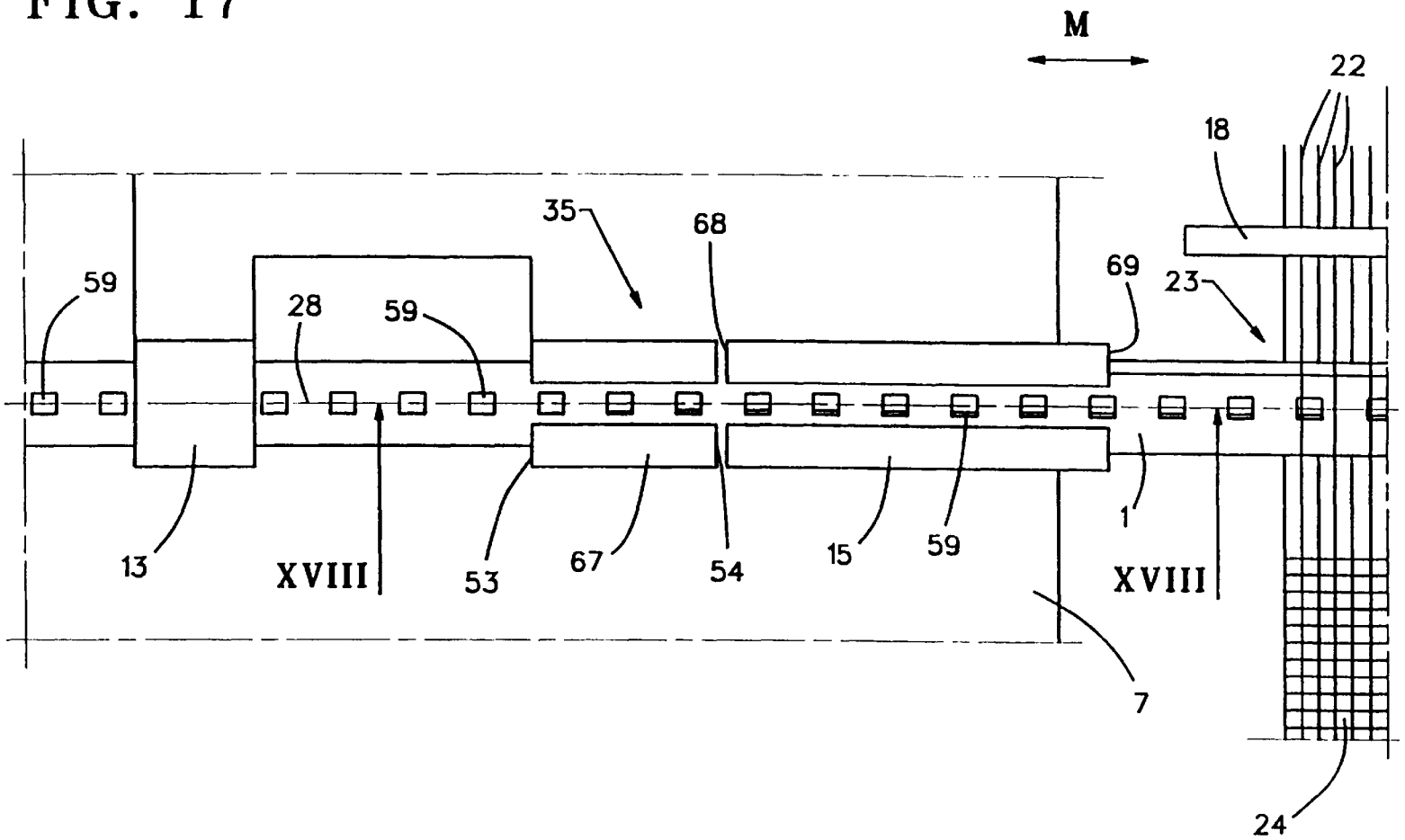
FIG. 17 is a view similar to FIG. 8 of another embodiment.
Figure 18:
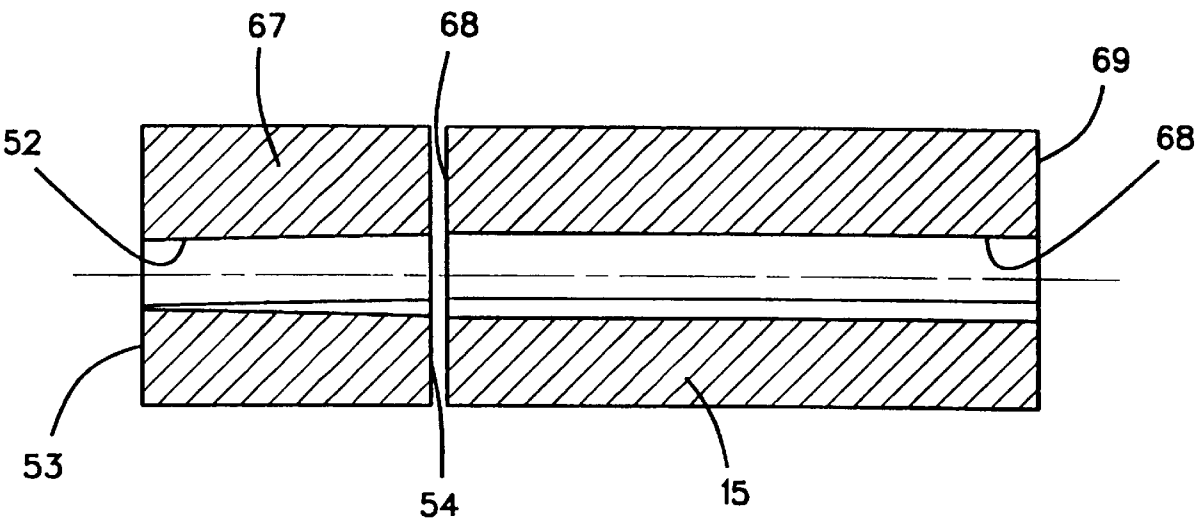
FIG. 18 is a section along line XVIII—XVIII of FIG. 17 (without a rapier)

In the third embodiment of FIGS. 17 and 18, the third guide element 35 is in the form of a block 67 comprising a guide channel 52 enclosing the rapier 1 and rotating between its intake 53 and its outlet 54 and correspondingly rotating the rapier 1 guided there within. In the adjoining second guide element 15 facing the shed 23, the rapier is guided in a straight path by a guide channel 68 and accordingly, it is not rotated any further between the intake 68 and the outlet 69 of this second guide element 15. In a variant of this embodiment (not shown) similar to FIGS. 17 and 18, the block 67 of the third guide element 35 directly adjoins the second guide element 15, that is, the outlet 54 of the block 67 rests against the intake 68 of the guide element 15. In still another embodiment, the block 67 and the second guide element 15 are integral. Because the gripper 3 driven by the rapier 1 must be moved out of the shed 23, an upwardly open slot is configured not only into the guide element 15 but also into the block 67.

Figure 20:
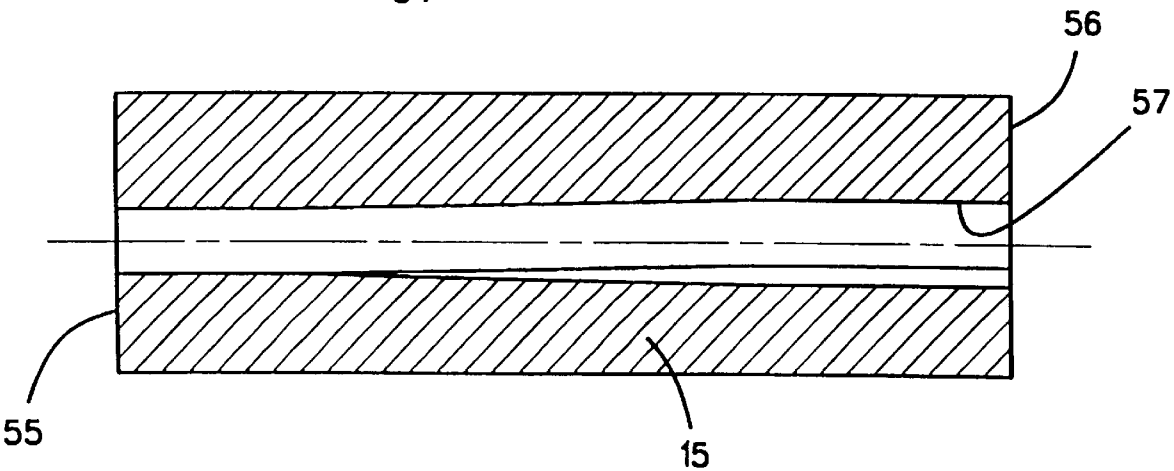
FIG. 20 is a section along line XX—XX of FIG. 19 (without a rapier).
Figure 19:
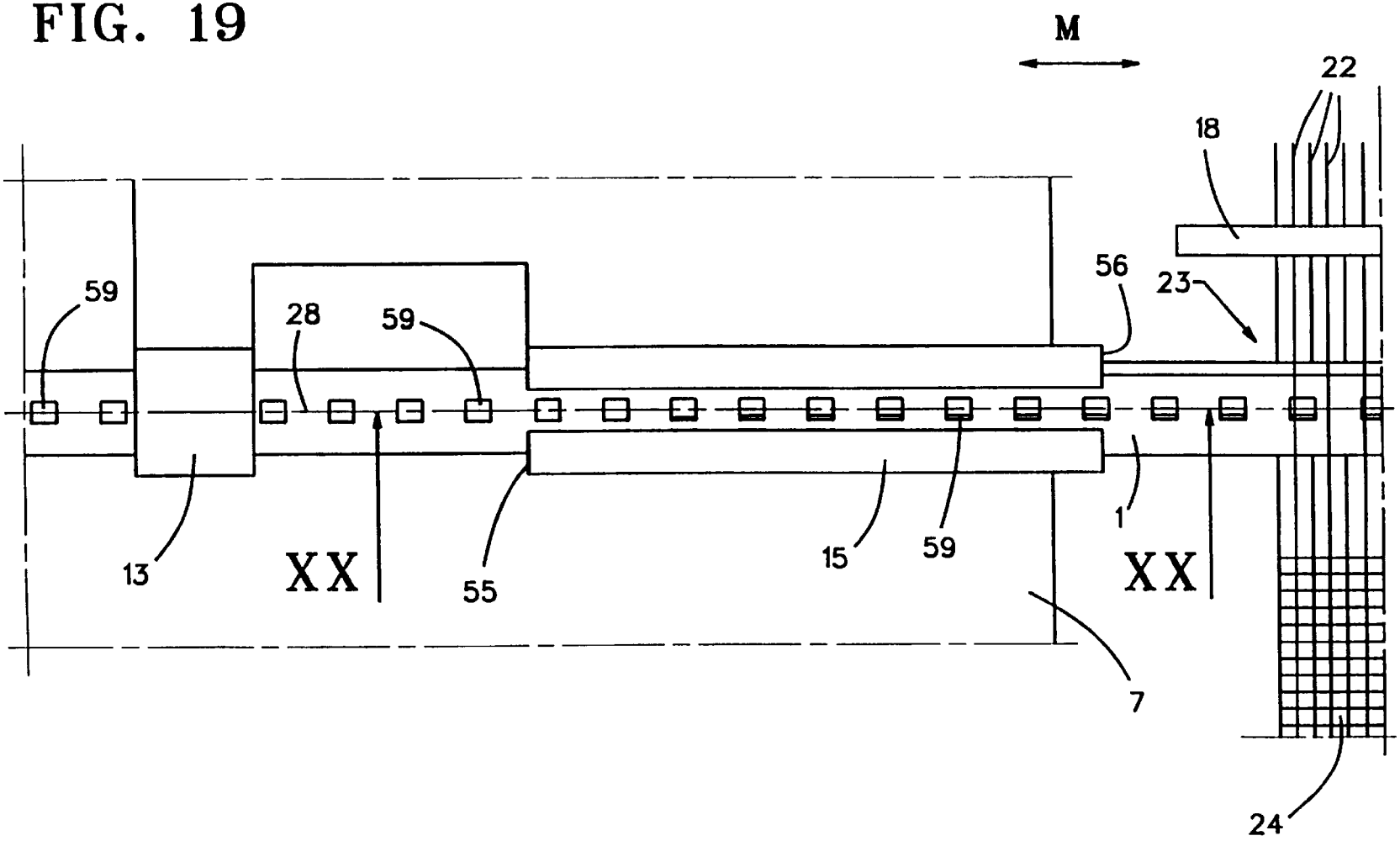
FIG. 19 is a view similar to FIG. 17 of a further embodiment.

In the embodiment of FIGS. 19 and 20, the second guide element 15 is configured with a guide channel or device 57 that is rotated about a longitudinal axis 28 of the rapier 1 to be guided, whereby the rotation of the rapier 1 about a desired angle takes place inside the second guide element 15, that is between its intake 55 and its outlet 56. The guide channel 57 is aligned in the vicinity of the intake 55 of the second guide element 15 with the guidance device of the first guide element 13, whereby the rapier 1 will not be rotated in the region between the first guide element 13 and the intake 55 of the second guide element 15.

In a variant of the embodiments shown in FIGS. 5 through 20, the guide elements will be affixed directly to the side frame 7. To change the angle through which the rapier 1 will be rotated when matching the shed geometry, it is required to replace the second guide element 15 and/or several parts of the third guide element 35 with other elements that cause a different rotation. All embodiments maintain that the rotation of the rapier 1 cannot be transmitted back to the drive wheel 9 and therefore, the rapier 1 will be guided in a tangential plane to this drive wheel 9 without the need to also guide the underside of the rapier 1 in the region of the first guide element 13.

Other elements are easily conceivable to implement the rotation of the rapier 1 about its longitudinal axis 28 between the drive wheel 9 and the shed 23. Illustratively combinations of the above described embodiments may be used for that purpose.

The rotation of the rapier 1 is exaggerated in the drawings to be more easily visible at the sides of the apertures 59 and at the narrow sides of the rapier 1. In practice, the rapier 1 is rotated by angels up to 15°.

The various guide means that were discussed above were discussed only in relation to the rapier 1 having one feed gripper 3. Obviously, corresponding guide means which rotate the rapier 2 that is configured with the receiving gripper 4, may also be used namely between the rapier's drive wheel 10 and the shed 23. Optionally the rapier 1 and the rapier 2 may be rotated at different angles into different positions, as a function, for example, of the geometry of the feed gripper 3 and/or of the receiving gripper 4. Obviously this angle also may be selected to be the same for both rapiers 1 and 2.

The second guide elements 15,16 are each associated with the shed and are mounted as close as possible to the reed 18 when weaving fabrics of a width less than the maximum weaving width. In such a case, the distance between the first guide element 13 and the second guide element 15 of the embodiment of FIGS. 2–5 will be enlarged and hence the rapier rotation will take place over a longer path. As regard the embodiments of FIGS. 5 through 17, the path along which the rapier 1 is rotated remains the same even when the distance between the first and second guide elements 13 and 15 is made larger.

The guide means of the invention may be used with rapiers 1,2 having different cross-sections, with the various guides obviously being matched to the cross-sections. Rapiers of rectangular cross-sections and of arbitrary height-to-width ratios, rapiers with trapezoidal cross-sections, rapiers with U-shaped cross-sections or rapiers with a longitudinal slot at the top or bottom side, as shown in the European patent document B 275,479, may be used. All such rapiers may be rotated between the drive wheels 9, 10 and the shed 23. Preferably, the rapiers are made of laminated plastic with inlays of fabric or carbon fibers or the like.

The invention is not restricted to gripper weaving machines wherein a filling is inserted by feed grippers 3 and receiving grippers 4 corresponding to two rapiers 1, 2 into a shed 23. The invention is also applicable to weaving machines wherein a single gripper inserts a filling into a shed 23, in which only one rapier is needed. Such a gripper may be a feed gripper 3 that picks up the filling at the insertion side and moves it to the opposite side while being displaced through the shed. Such a gripper may also be a type of receiving gripper 4 that receives a filling at the insertion side and moves it to the opposite side while being displaced through the shed 23.

It is possible, moreover, to rotate the rapier(s) not only between a drive wheel 9, 10 and a shed 23, but also to rotate the rapier(s) within the shed 23 using the guide posts 21. For that purpose and in an illustrative manner, guide posts 21 similar to those disclosed in the U.S. Pat. No. 5,413,151 can used in a manner similar to that of the embodiment of the third guide element 35 of FIGS. 13 through 16 that are configured with guide means having different angles.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

The invention is not restricted to the above shown and described illustrative embodiments. The scope of protection is defined by the claims.

What is claimed is:

1. A gripper weaving machine comprising:

a gripper;

at least one rapier carrying the gripper and being displaceable into and then out of a shed by a drive wheel;

guide elements being arranged to twist the rapier around its longitudinal axis, the guide elements arranged to maintain the rapier in contact with the drive wheel and in alignment with the shed, the guide elements being substantially tangentially arranged relative to the drive wheel; and the at least one rapier being driven by the drive wheel and guided outside the shed by the guide elements.

2. The gripper weaving machine as claimed in claim 1, wherein two or more of the guide elements with differently rotated guidance devices are mounted in a replaceable manner with an attaching device on the gripper weaving machine.

3. The gripper weaving machine as claimed in claim 1, wherein the guide elements include a first guide element mounted in a region of the drive wheel and a second guide element including an outlet, the second guide element being mounted at a distance from the first guide element next to the shed and the outlet of the second guide element having been rotated toward a plane that is tangential relative to the drive wheel.

4. The gripper weaving machine as claimed in claim 3, wherein the first and the second guide elements form substantially straight and mutually rotated guidance devices for the rapier.

5. The gripper weaving machine as claimed in claim 3, further comprising a third guide element mounted between the first guide element and the second guide element and arranged to rotate the rapier.

6. The gripper weaving machine as claimed in claim 5, wherein the first guide element includes an outlet and the third guide element includes an intake that is flush with the outlet of the first guide element.

7. The gripper weaving machine as claimed in claim 4, further comprising a third guide element having two leaf springs rotated about a longitudinal axis running in the direction of motion of the rapier and guiding the rapier between them.

8. The gripper weaving machine as claimed in claim 1, wherein the guide elements include first, second and third guide elements each having a guidance device, the third guide element having several mutually spaced consecutive parts, the third guide element being mounted between the first guide element and the second guide element, and the guidance devices of the guide elements being rotated in stepwise angular increments starting at the first guide element.

9. The gripper weaving machine as claimed in claim 1, wherein the guide elements include a first guide element having an outlet, and a second guide element having an intake and a guidance device with which the intake of the second guide element is substantially flush with the outlet of the first guide element.

10. The gripper weaving machine as claimed in claim 1, wherein the guide elements include first and second guide elements and a third guide element, the second guide element together with the third guide element and/or the first guide element forming a replaceable sub-assembly that is attached to the weaving machine with one or more attaching devices.

11. The gripper weaving machine as claimed in claim 1, wherein the at least one rapier comprises first and second rapiers, the first rapier being connected to the feed gripper and the second rapier being connected to a receiving gripper, the rapiers being guided on opposite sides of the shed by the guide elements rotating the respective rapiers at equal or different angles.

* * * * *